US006856296B1

(12) United States Patent
Slay

(10) Patent No.: US 6,856,296 B1
(45) Date of Patent: Feb. 15, 2005

(54) RADIO ANTENNA AND TRANSMISSION LINE

(76) Inventor: Larry George Slay, 7724 Chalkstone Dr., Dallas, TX (US) 75248-5320

( * ) Notice: Subject to any disclaimer, the term of this patent is extended or adjusted under 35 U.S.C. 154(b) by 8 days.

(21) Appl. No.: 10/445,698

(22) Filed: May 27, 2003

(51) Int. Cl.[7] ..... H01Q 1/32
(52) U.S. Cl. ..... 343/715; 343/711; 343/850
(58) Field of Search ..... 343/711, 713, 343/715, 895, 900, 901, 702, 850, 853

(56) References Cited

U.S. PATENT DOCUMENTS 2,313,046 A 3/1943 Bruce
5,801,662 A * 9/1998 Itoh ..... 343/702
6,366,247 B1 * 4/2002 Sawamura et al. ..... 343/702
6,531,986 B2 * 3/2003 Saito ..... 343/702
6,720,935 B2 * 4/2004 Lamensdorf et al. ..... 343/895

* cited by examiner

*Primary Examiner*—Hoang V. Nguyen

(57) ABSTRACT

A radio antenna that includes top and base sections. An insulator is disposed between the sections. A device provides an electrical load between the sections. The transmission line assembly transparent to antenna radiation fields carries an electrical signal between the sections and the electrical load providing device that is in a mechanical and radiation efficient location.

18 Claims, 10 Drawing Sheets

RADIO ANTENNA AND TRANSMISSION LINE

BACKGROUND OF THE INVENTION

The use of radios in automobiles, recreational vehicles, off-road vehicles, aircraft, boats, ships and buildings is well known. The type of antennas used with these radios and transmitters is determined by several factors; such as, wavelength, size, and weight. The antennas typically used with the receivers, transceivers, and transmitters, are whips, telescoping whips, or other types of electrically short rod antennas that may be electrically loaded or non-loaded. Usually, these antennas make use of the vehicle body as the counterpoise or ground plane part of the antenna system even though some larger vehicles use a loaded vertical dipole arrangement. Even though a dipole antenna does not require a ground plane to complete the antenna system, the ground plane contributes to the overall antenna radiation pattern or gain in the dipole antenna.

For communications with distances that are generally equal to or greater than line-of-sight (LOS), the radios normally operate in the High Frequency (HF) range, which is from about 2 to 30 MHZ. The radios are traditionally used with electrically short whips that are less than a quarter wavelength long with loading coils at the radiator base (base loading) or at the approximate center (center loading), a whip or capacity hat is then provided above the coil to complete the antenna radiating assembly. Even though the center loaded antenna systems are more efficient because of the higher gain than base loaded antennas, the centered loaded antenna systems are mechanically inefficient because of large heavy electrical devices, such as caused when inductors are providing the load, being mounted in the center.

At HF ranges and below, quarter wavelength vertical antennas having no artificial loading are physically too large for standard mobile in motion use. For example, a quarter wavelength antenna operating at 2 MHZ has a length of approximately 117 feet and at 30 MHZ has a length of approximately 8 feet. Even though maritime radios can generally tolerate taller antennas than aeronautical radios, aeronautical antenna designs must meet the aerodynamic requirements of the aircraft with minimum wind drag while maintaining the required radiation efficiency and pattern.

Because of these considerations, a practical mobile antenna is a compromise between a full size vertical antenna with no loading and an antenna with some kind of electrical loading. The design of HF and lower frequency antennas requires serious consideration of maximizing radiation efficiency while at the same time providing a mechanical configuration that has minimum hardware antenna complexity in relation to the vehicle. These considerations apply to all antennas, fixed or mobile stations.

An example of a prior art radio antenna system is described in U.S. Pat. No. 2,313,046. The antenna system described in the patent appears to be used in the 50 to 60 MHZ frequencies (the Very High Frequency band). Thus, the quarter wavelength is many times greater than the length of the antenna structure. The system is adjustable from the base, as opposed to base loading the actual antenna radiator, of the structure to permit a higher degree of efficiency to be readily obtained at selected frequencies within the VHF band of frequencies. It has been discovered that the efficiency of many antenna systems and this prior art system is improved by using the improved electrical transmission line technique disclosed herein.

BRIEF SUMMARY OF THE INVENTION

In accordance with the present invention, there is provided a radio antenna that comprises top and base sections. An insulator is disposed between the sections. A device provides an electrical load between the sections. An electrically transparent transmission line assembly carries an electrical signal between the sections and the electrical load providing device.

Further, in accordance with the present invention, there is provided a transmission line assembly for increasing a characteristic cable impedance utilizing a plurality of pairs of conductors added to one another across an electrical load providing device. The assembly comprises a plurality of pairs of conductors. Each of the conductors of the plurality of pairs have substantially the same impedance rating and are substantially the same length. Each of the plurality of pairs of conductors are normally shielded as a single unit. One of the conductors of a first pair has an end connected on one side of an electrical load providing device, one of the conductors of a last pair has an end connected on another side of the electrical load providing device. The other conductors of the plurality of pairs are connected to one another to form a plurality of closed loops.

BRIEF DESCRIPTION OF THE SEVERAL VIEWS OF THE DRAWING

Objects and advantages of the invention will become apparent upon reading the following detailed description and upon reference to the drawings, wherein like reference characters are used throughout to designate like parts.

DETAILED DESCRIPTION OF THE INVENTION

Figure 1:
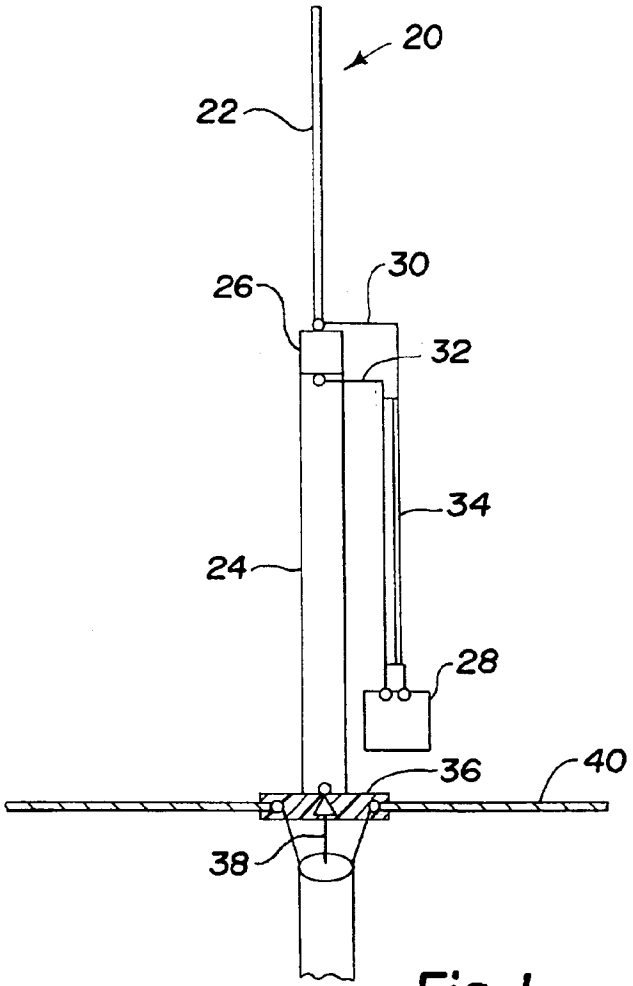
FIG. 1 is a representation of a first embodiment of a radio antenna constructed according to the present invention.
Figure 7:
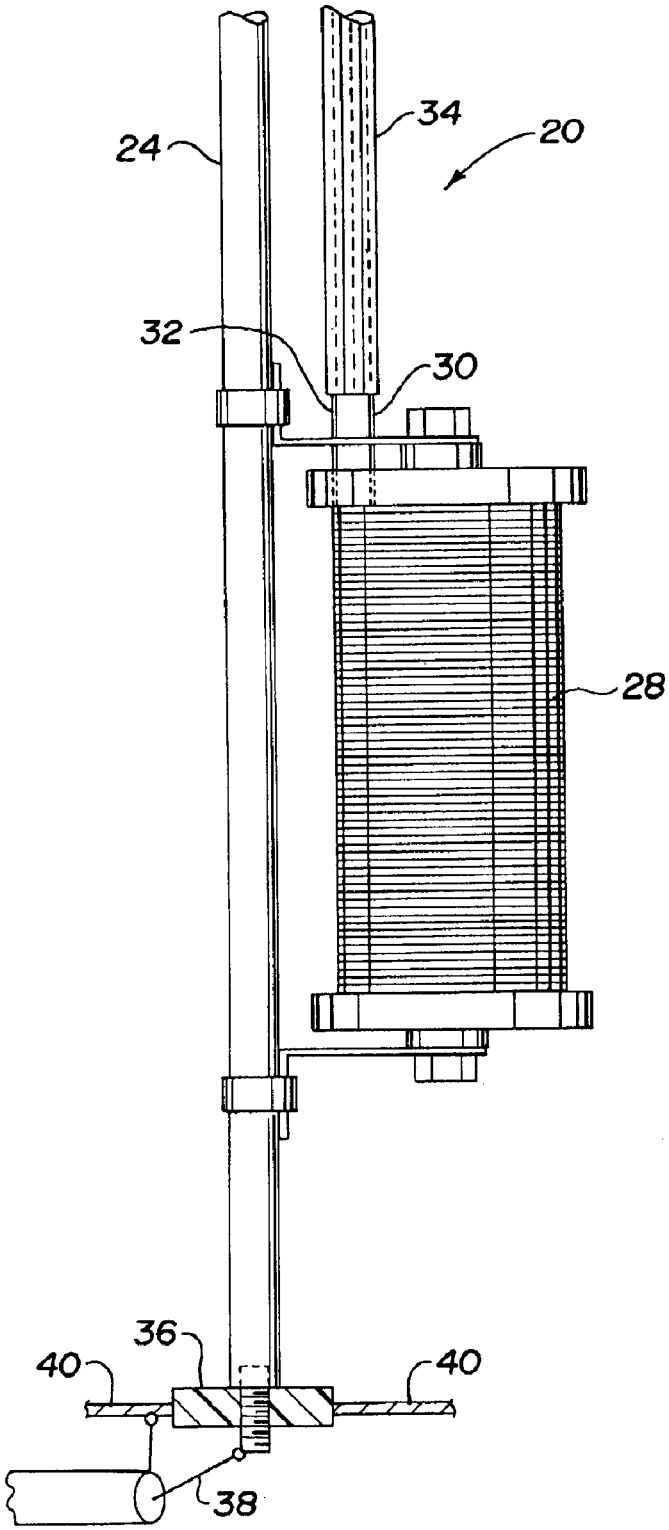
FIG. 7 is an enlarged view of a portion of the first embodiment of the invention shown in FIG. 1.
Figure 8:
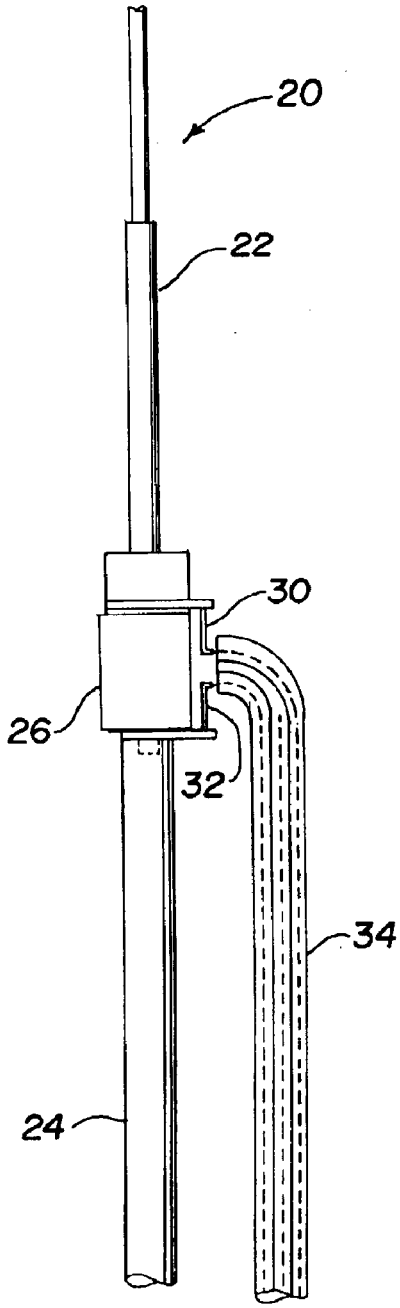
FIG. 8 is an enlarged view of another portion of the first embodiment of the invention shown in FIG. 1.

Turning now to FIGS. 1, 7 and 8, there is shown a first embodiment 20 of a radio antenna system constructed according to the present invention. First embodiment 20 is shown as an external cable loading configuration.

A top section 22 is provided in first embodiment 20 as the top radiating element. Top section 22 is conventional apparatus and nay be a whip, an end cap, capacity hat or similar apparatus.

A base section 24 is provided in first embodiment 20 as the bottom radiating element. Base section 24 is conventional apparatus and may be an elongated cylindrical tube, elongated square tube or a tubular shape with any other cross-section configuration, a solid rod, wires or similar apparatus. Base section 24 is shown as being attached to an insulator 36, which is connected to a vehicle 40, such as, an automobile, a boat, a ship, an aircraft, a satellite or similar device that may support the radio system using embodiment 20. Although vehicle 40 is shown as forming a ground plane for the radio system, plane 40 also represents a counterpoise plane, the earth or radials for ground mounted antennas when used with the appropriate apparatus.

An insulator 26 is provided in first embodiment 20 to prevent electricity from passing between top section 22 and base section 24. Although insulator 26 is shown as a single conventional insulator disposed between top and base sections 22 and 24, respectively, additional insulators may be used at other locations to utilize other transmission line assemblies and associated electrical load producing devices for multiband antennas.

Electrical load producing device 28 is conventional apparatus; such as, an adjustable coil, adjustable capacitor or similar apparatus of active or passive complex circuitry that produces an electrical load between top section 22 and base section 24 via transmission line assembly 34.

In embodiment 20, transmission line assembly 34 is normally constructed from shielded and balanced lines or conductors. When desired, however, transmission line assembly 34 may be constructed from unshielded and unbalanced lines.

To minimize the effects of the movement of air or movement of the antenna on the structural complexity of first embodiment 20, constructed according to the present invention, electrical load producing device 28 is displaced away from top section 22 and base section 24 by a distance sufficient to place the electrical load producing device in a more mechanically and radiation efficient remote location. Such arrangement will also improve the structural stability of the antenna system and prevent damage to all sections. When antenna system 20 is positioned on vehicle 40 as shown in FIGS. 7 and 8, base section 24 is connected to an insulator 36 and then to vehicle 40. The load producing device 28 can also be positioned within the body of vehicle 40.

When desired, a single or multiple dipole array, yagi, log-periodic, any multi-element multi-band array or any applicable candidate element of any antenna may be constructed with two or more pairs of top sections 22 and base sections 24 disposed in close proximity and extending away from one another.

Generally, for single dipole antennas a single common electrical load producing device is used with dual transmission line assemblies for tuning or resonating the antenna dipole elements as opposed to using dual electrical load producing devices. As an example, a multi-element antenna array; such as, a vertical directional antenna can be constructed using any number of antenna system configurations depicted in FIG. 1 using a common counterpoise or ground plane 40, which may include the earth or radials for ground mounted antennas. In most cases, any antenna radiating element can be loaded utilizing the techniques described herein.

As best seen in FIGS. 2, 12, 13, and 14 there is shown a second embodiment 50 of a radio antenna system constructed according to the present invention that provides an electrical signal via conductor 68 to or from a conventional radio transmitter or receiver (not shown). Antenna system 50 is an internal cable loading configuration that includes a top section or a top radiating element 52, a base section or a bottom radiating element 54, an insulator 56, and an electrical load producing device 58 that may be unshielded or shielded. Load Producing device 58 may be located above or below the ground plane as well as being disposed externally or internally of the vehicle, is connected to top section 52 by a conductor 60 and to base section 54 by a conductor 62. The other end of conductors 60 and 62 are connected to transmission line assembly 64. Top section 52 is conventional apparatus and may be similar to that described for top section 22. Base section 54 is conventional apparatus and may be constructed from an elongated cylindrical tube, an elongated square tube, or an elongated tube of any desired shape, or any similar apparatus in which transmission line 64 is disposed. Insulator 56 is conventional apparatus that electrically insulates top section 52 from base section 54. Although insulator 56 is illustrated as a single insulator, multiple and additional insulators may be used at other locations along the same element to utilize other transmission line assemblies and associated electrical load producing devices for multi-band antennas. Electrical load producing device 58 is conventional apparatus similar to that described for device 28 that produces an electrical load between top section 52 and base section 54. Transmission line assembly 64 is a shielded and balanced line constructed in accordance with the present invention. Transmission line assembly 64 may be constructed from unshielded and unbalanced lines so long as the transmission line assembly is electrically transparent. The transmission line assembly is considered transparent when shielded from antenna radiation fields while carrying the electrical signal between the sections and the electrical load providing device.

Normally, base section 54 is attached to and insulated by an insulator 66 to a counterpoise or ground plane 70 formed by a vehicle using a radio system. The counterpoise or ground plane 70 of the radio system can include the earth or radials for ground mounted antennas as previously explained in relation to ground plane 40 shown in FIG. 1.

As with the embodiment shown in FIG. 1, when desired, a single or multiple dipole array, yagi, log-periodic, any multi-element multi-band array or any applicable candidate element of any antenna may be constructed with two or more pairs of top sections 52 and base sections 54 disposed in close proximity and extending away from one another.

Generally, for single dipole antennas a single common electrical load producing device may be used with dual transmission line assemblies for tuning or resonating the antenna dipole elements as opposed to using dual electrical load producing devices.

Figure 2:
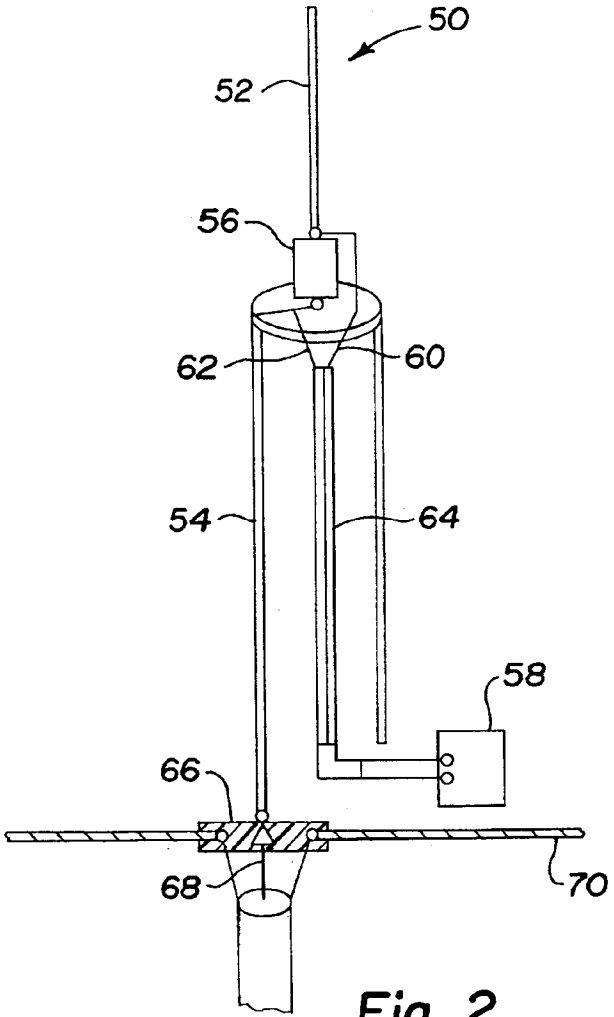
FIG. 2 is a representation of a second embodiment of a radio antenna constructed according to the present invention.

As an example, a multi-element antenna array; such as, a vertical directional antenna can be constructed using any number of antenna system configurations depicted in FIG. 2 using a common counterpoise or ground plane 70 that includes the earth or radials for ground mounted antennas.

Device 58 is displaced away from insulator 56 formed at the junction of sections 52 and 54 by a distance sufficient to place electrical load producing device 58 in a more mechanically or radiation efficient remote location.

Figure 12:
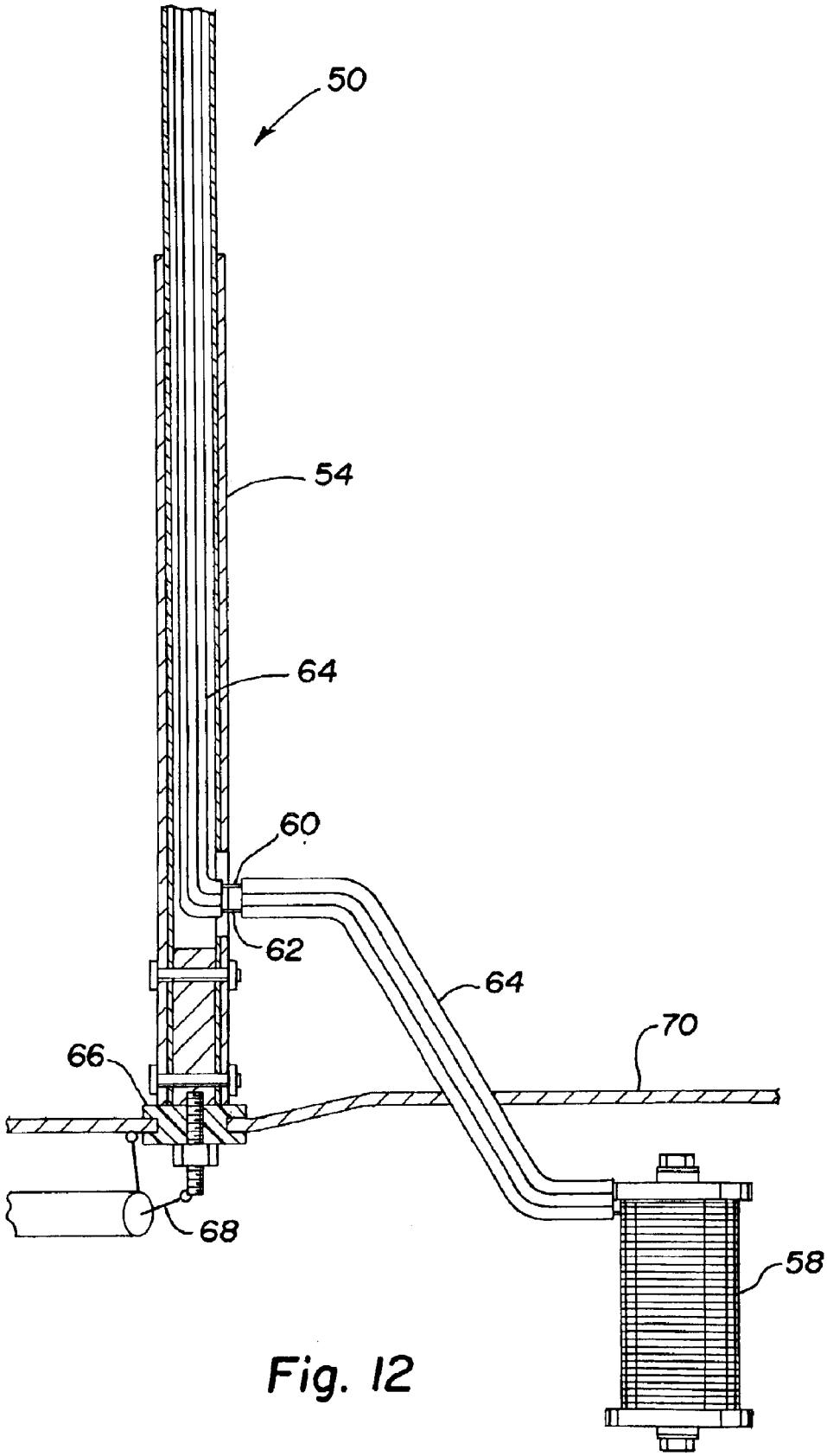
FIG. 12 is an enlarged view showing a variation to a portion of the second embodiment of the invention shown in FIG. 2.
Figure 13:
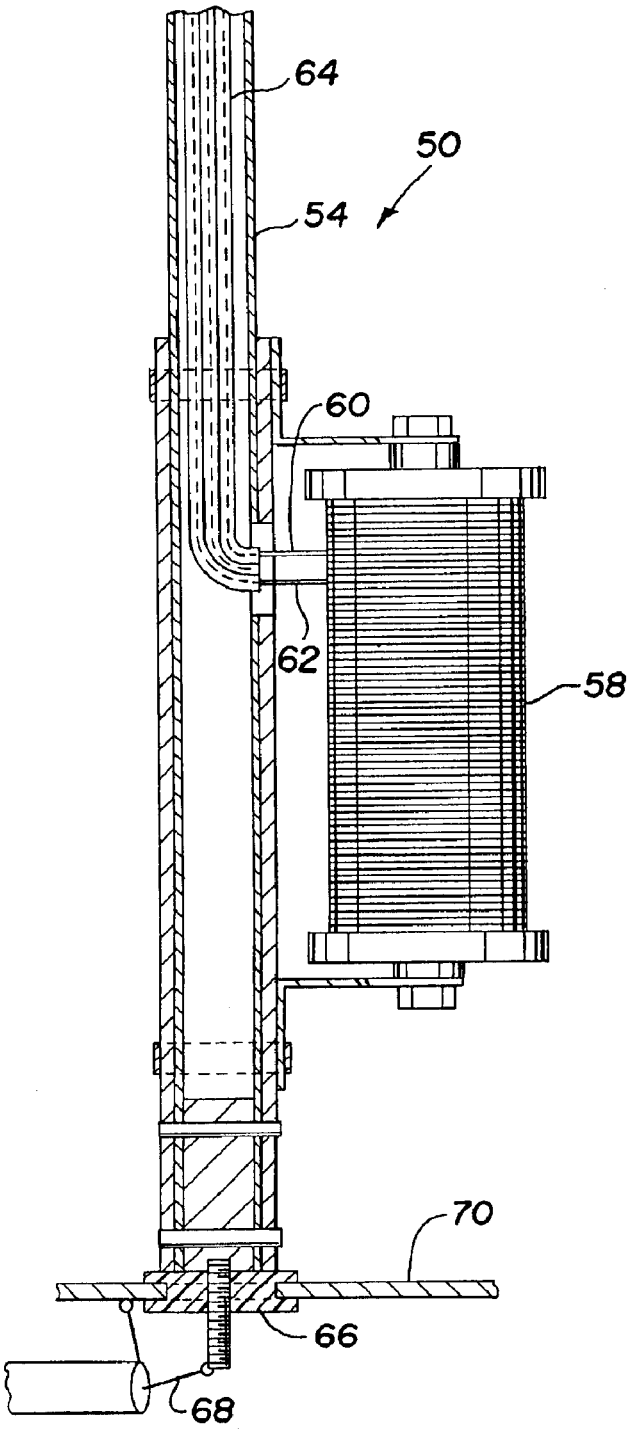
FIG. 13 is an enlarged view of a portion of the second embodiment of the invention shown in FIG. 2.
Figure 14:
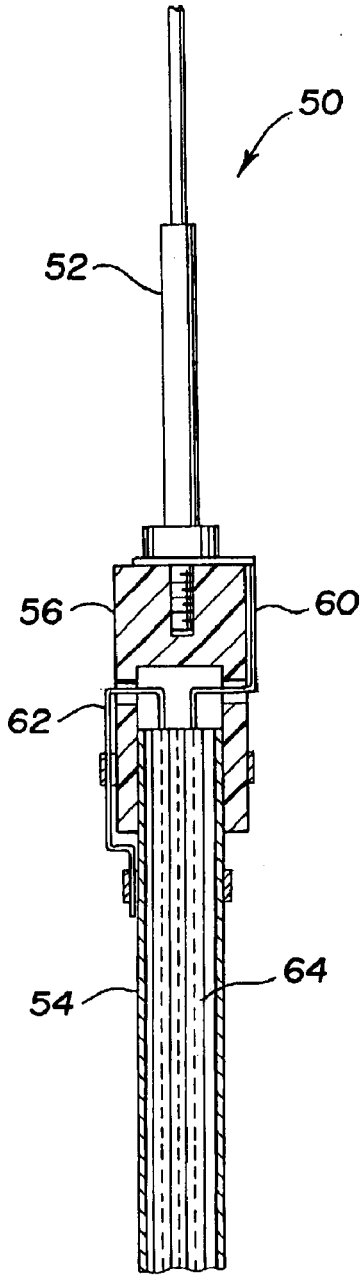
FIG. 14 is an enlarged view showing a portion of the second embodiment of the invention shown in FIG. 2.

In FIG. 12, there is shown a load producing device 58 located internal to the vehicle that is below the counterpoise or ground plane 70. In FIGS. 13 and 14, a load producing device 58 is shown as being disposed external to the vehicle. When load producing device 58 is disposed a relatively substantial distance away from base section 54, the transmission line assembly uses an extension 64 to interconnect internal transmission line assembly 64 with remote load producing device 59. Normally, there is no continuous continuity with the shield of the external transmission line assembly 64. In either situation, the overall internal shields are opened to allow conductors 60 and 62 to pass into base section 54. Using the disclosed invention, transmission line assembly runs may have the overall shields opened anywhere along the lines to reduce or eliminate external undesired RF current flow.

Figure 3:
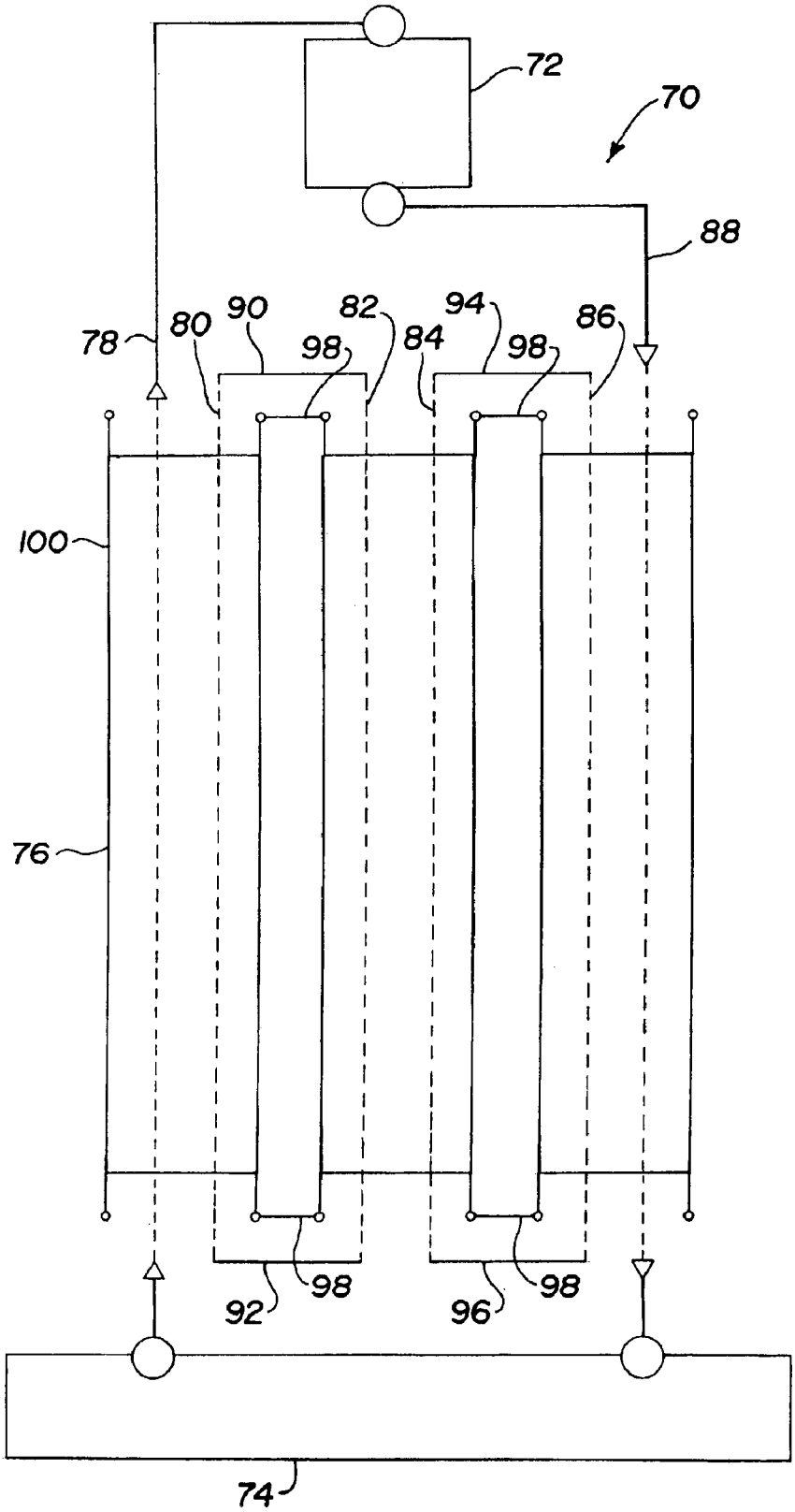
FIG. 3 is a schematic representation of a transmission line assembly constructed according to the present invention that may be used in the radio antennas shown in FIGS. 1 and 2.

Turning now to FIG. 3, there is shown a schematic representation 70 of antenna systems 20 and 50. Transmission line 76, which represents transmission lines 34 and 64 in FIGS. 1 and 2, interconnects a block 72, which represents insulators 26 and 56 shown in FIGS. 1 and 2, and block 74, which represents electrical load producing devices 28 and 58 shown in FIGS. 1 and 2.

In the preferred embodiment, transmission line assembly 76 is formed from three pairs of conductors. The six conductors are paired as 78 and 80, 82 and 84, and 86 and 88 and each pair is shielded 100. At one end of conductors 80 and 82 are jumpered in series with one another by lines 90 and at the other end of conductors 80 and 82 are jumpered in series with one another by line 92 to form a first closed loop. In like manner, conductors 84 and 86 are jumpered in series with one another at each end by lines 94 and 96, to form a second closed loop. Conductors 78 and 88 are then connected to device 72 and device 74. Conductors 78 and 80, 82 and 84, 86 and 88 are normally chosen to have substantially the same impedance rating and are substantially the same length. When desired, the outer shield 100 is formed by jumpering the shield of each conductor pair at each end as represented by jumpers 98. Normally, the outer shield 100 as a group remains opened at insulator 72 and at the electrical load producing device 74 to eliminate external shield undesirable RF current flow. When desired, unbalanced shielded conductors can be used to synthesize the required transmission line assembly for the antennas.

Figure 4:
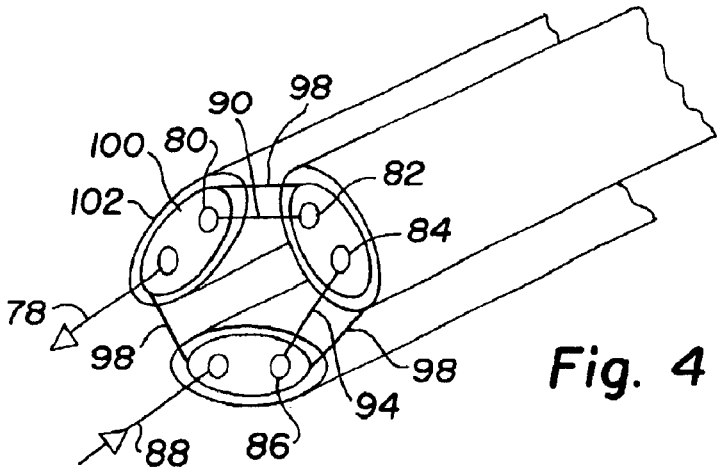
FIG. 4 is a perspective representation of a first transmission line assembly that may be used in accordance with the antenna embodiments shown in FIGS. 1 and 2.
Figure 5:
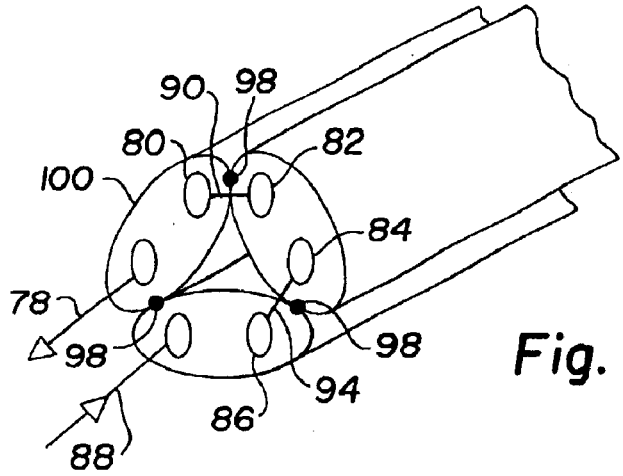
FIG. 5 is a perspective representation of a second transmission line assembly that may be used in accordance with the antenna embodiments shown in FIGS. 1 and 2.
Figure 6:
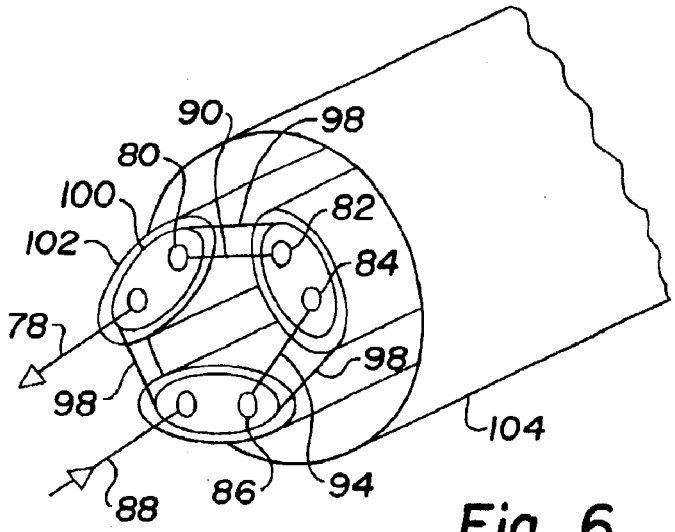
FIG. 6 is a perspective representation of a third transmission line assembly that may be used in accordance with the antenna embodiments shown in FIGS. 1 and 2.

FIGS. 4–6 are perspective views of shielded cables that are used in providing the cable type transmission line assembly 76 shown in FIG. 3. As shown in FIGS. 4 and 6, outer shield 100 is covered by an insulation material 102, which is a part of the individual shielded conductor pairs used in conventional shielded cables. Insulation 102 is omitted from FIG. 5 to assist in showing the interconnecting arrangement between the individual cables. A typical routing of shielded cables of the transmission line assembly within tube 104 is shown in FIG. 6. Normally, the shields of the transmission line cables are not connected to outer tube 104 and are left floating at both ends.

Each individual shielded balanced transmission line cable 100 of FIG. 3 can be constructed using two unbalanced coaxial type cables connected back to back where the coaxial shields are connected to each other at each end and the remaining center conductors are used to form the balanced transmission line pair of conductors. The paired coaxial shields are then treated the same as cable 100 in FIG. 3. This equivalent balanced transmission line assembly is identical in overall performance using balanced shielded pairs as shown in FIG. 3.

Figure 9:
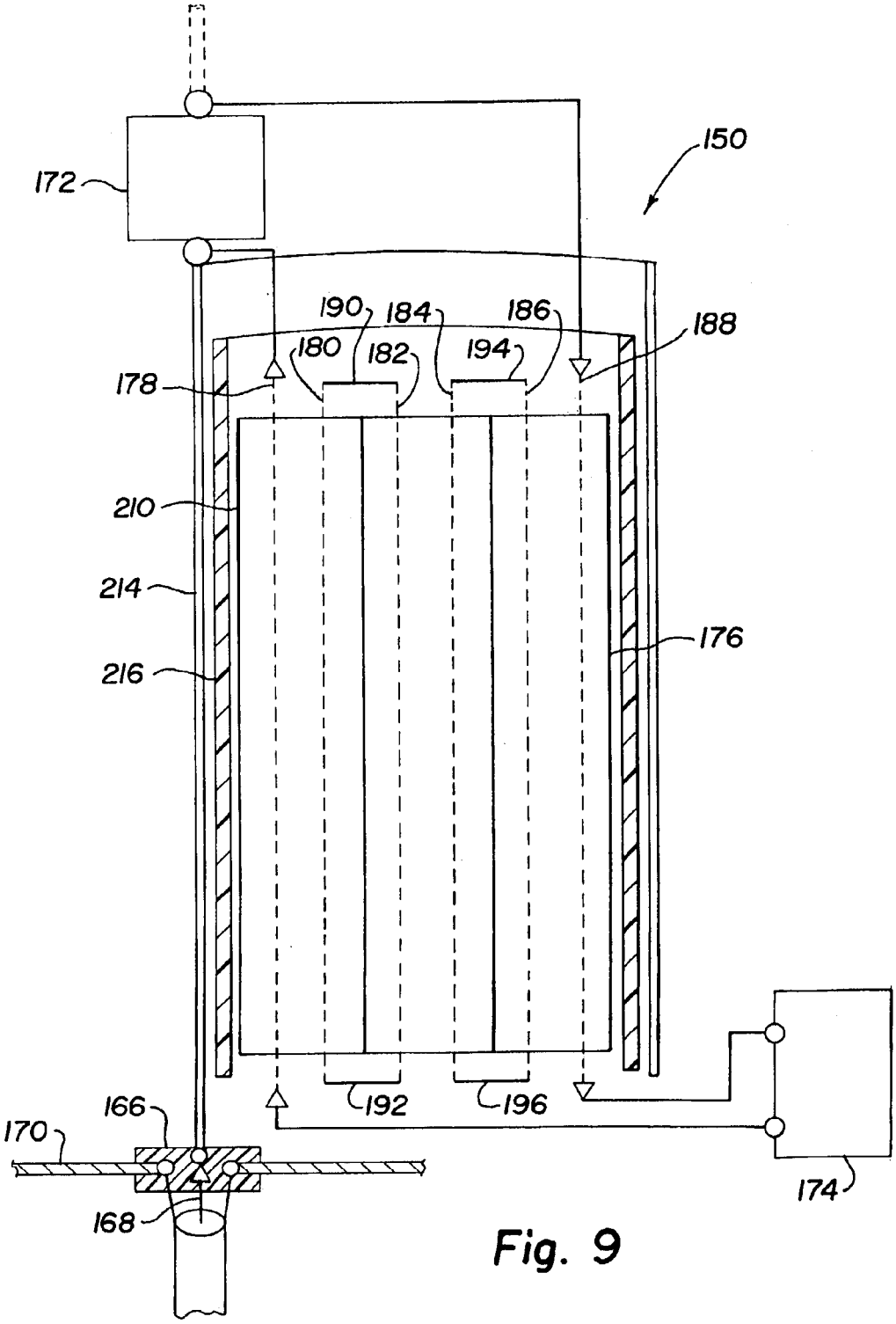
FIG. 9 is a schematic representation of the third transmission line assembly shown in FIG. 6 used in the second embodiment of a radio antenna shown in FIG. 2.

Turning now to FIG. 9, there is shown a schematic representation of an antenna system 150; such as that shown in FIG. 1 or 2, that uses a transmission line assembly 176, insulators that are represented by block 172, and an electrical load producing device that is represented by block 174. The antenna system represented as 150 can be antenna embodiment 20 or 50 shown and described in relation to FIG 1 or 2. The load producing device represented as block 174 can be any load producing device described in relation to load producing devices 28 or 58 shown and described in relation to FIG. 1 or 2.

Transmission line assembly 176 is formed by three paired conductors being stacked together and floated, i.e., insulated from the metal walls, within inner tube 210. Six conductors are paired as 178 and 180, 182 and 184, and 186 and 188. At each end, conductors 180 and 182 are jumpered in series with one another by lines 190 and 192 to form a first closed loop, and conductors 184 and 186 are jumpered in series with one another by lines 194 and 196 to form a second closed loop. Conductors 178 and 188 are then connected to device 172 and electrical load producing device 174. The conductors are normally chosen to have substantially the same impedance rating and be of substantially the same length. As shown, the shield walls of the conductors are inherently electrically jumpered to eliminate the need for additional jumpers. When desired, outer tube 214 and insulator 216 are not used where inner shield tube 210 surrounding the transmission line assembly is a base section, such as base section 54 shown in FIG. 2. As previously explained, inner shield tube 210 normally remains opened at insulator 172 and at electrical load producing device 174 to eliminate external shield undesirable RF current flow.

Although two loops are used in a preferred embodiment of three paired and shielded conductors, this number can be varied depending on the optimization of the efficiency of the load transfer.

Further, the number of stacked conductors, either unbalanced or balanced, can be used in the transmission line assemblies depending on the frequency, line lengths, power, and similar design variables.

Figure 10:
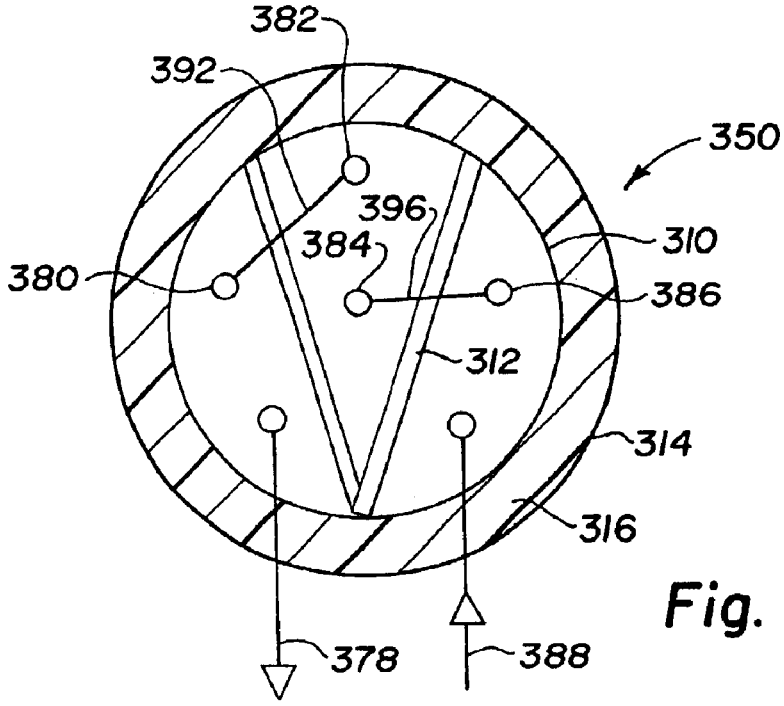
FIG. 10 is an end view of a first embodiment of a transmission line assembly that may be used in accordance with the antenna embodiments shown in FIGS. 1 and 2.

Turning now to FIG. 10, there is shown a transmission line assembly 350 constructed to perform in accordance with the embodiment shown and described in FIG. 9. An elongated tube 310 is made of metal when forming base section 54 of antenna system 50 shown in FIG. 2. Tube 310 has a metal V-shaped form 312 to shield and separate paired conductors 378 and 380, 382 and 384, and 386 and 388. Conductors 380 and 382 are connected by jumper 392 and conductors 384 and 386 are connected by jumper 396 with a similar jumpered arrangement, at the other ends of the conductors. When desired, a separate shield tube 314 circumscribing an insulator 316 disposed around tube 310. When tube 314 is used in the embodiment shown in FIG. 2, tube 314 becomes the active radiating element connected to conductor 68.

Figure 11:
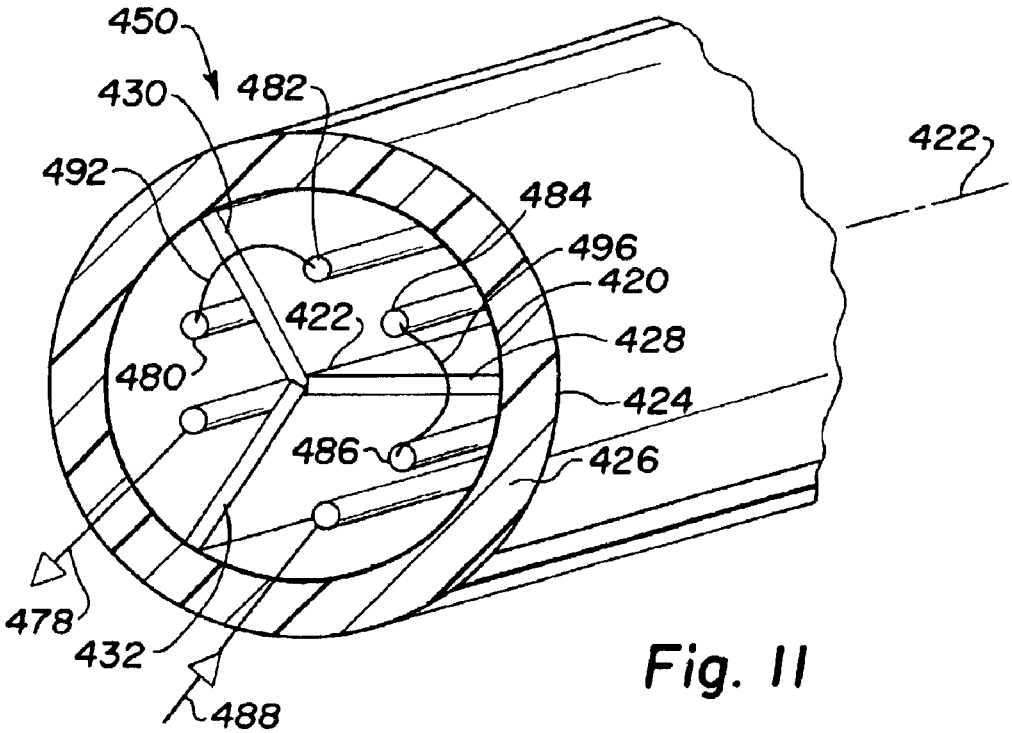
FIG. 11 is a perspective view of a second embodiment of a transmission line assembly that may be used in accordance with the antennas embodiments shown in FIGS. 1 and 2.

Turning now to FIG. 11, there is shown another transmission line 450 constructed to perform in accordance with the embodiment shown and described in FIG. 9. An elongated tube 420 is metal when forming base section 54 of antenna system 50 shown in FIG. 2. Tube 420 has a metal Y-shaped form with a central axis 422 with three symmetrical arms 428, 430, and 432 that extend radially from central axis 422 to engage with metal elongated tubular body 420. The metal arms form a wall that shields and separates the paired conductors 478 and 480, 482 and 484, and 486 and 488. Conductors 480 and 482 are jumpered by 492 and conductors 484 and 486 are jumpered by 496 with a similar arrangement at the other end. When desired, a separate shield tube 424 circumscribes an insulator 426 that is disposed around tube 420. When tube 424 in the embodiment shown in FIG. 2, tube 424 becomes the active radiating element connected to conductor 68.

As previously explained, the number of stacked paired conductors used in the transmission line assembly depends on the frequency, line lengths, power, and similar design variables.

Although the tubes shown in FIGS. 9, 10 and 11 are shown as having a circular cross-section and straight wall shield partitions, the cross-section shape of the tubes can be any desired shape; such as, a square tube, triangular tube, or any other symmetrical or irregular shape. Also, even though the shield partitions or walls shown in these figures are illustrated as being straight, the inner shield walls may be any desired shape that is required for the antenna application or requirements.

For further clarification, if needed, FIG. 2 generally represents a tubular base section 54 with an enclosed transmission line assembly 64 made of stacked paired shielded individual conductors or cables. FIGS. 9, 10 and 11 show an alternate, electrically equivalent, mechanical transmission line assembly made of dual tubular metal or wire mesh formed into any required shape that is electrically insulated by insulator 316 or 426 with internal metal partitions of the inner tube for shielding the paired conductors. Outer tubes 314 or 424 are equivalent to base section tube 54 when the configuration concept shown in either FIG. 10 or FIG. 11 is used. In addition, an alternate configuration can be made by removing outer tubes 314 or 424 and insulators 316 or 426 can be removed for those cases not requiring a second outer tube, as in a single tube configuration. Tubular parts 310 or 420 then become the active antenna or radiating element base section 54 shown in FIG. 2.

Figure 15:
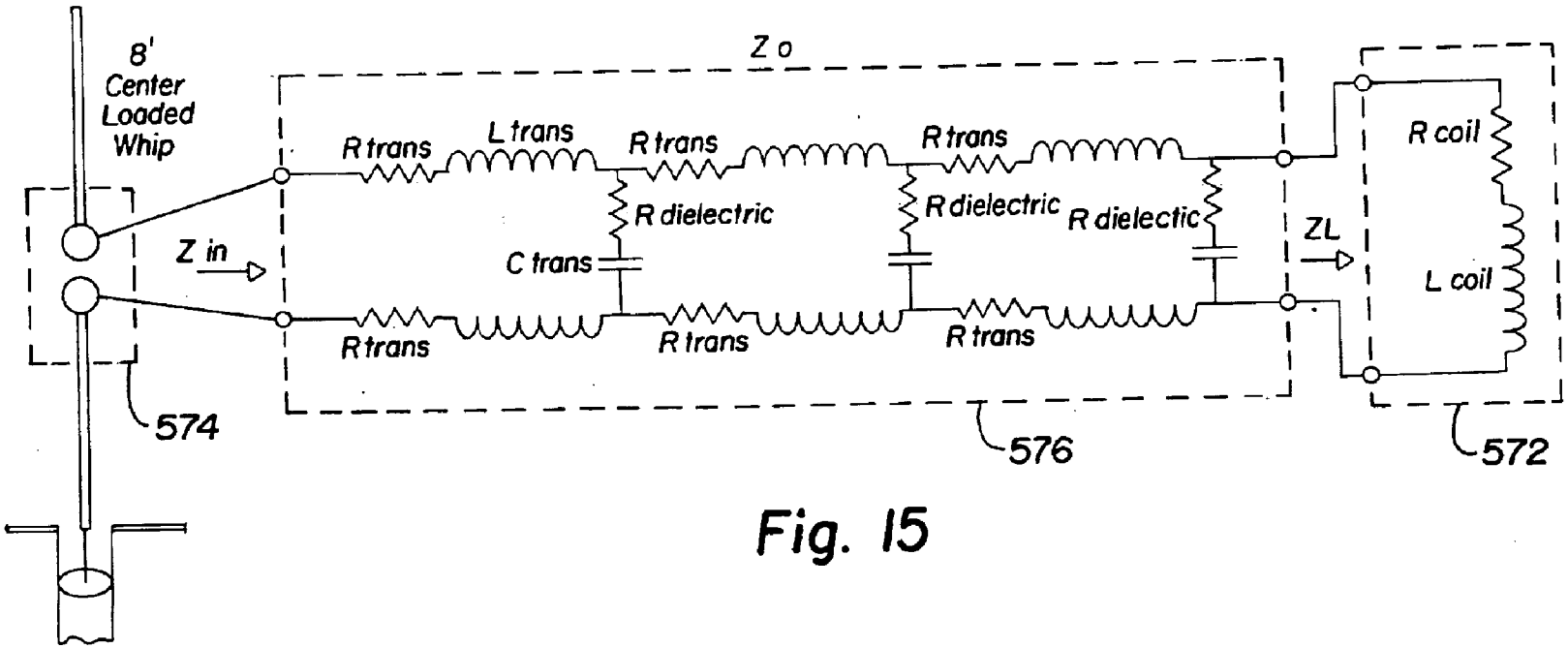
FIG. 15 is a circuit schematic showing representative resistive lose elements for an antenna, a transmission line assembly and an electrical load producing device.
Figure 16:
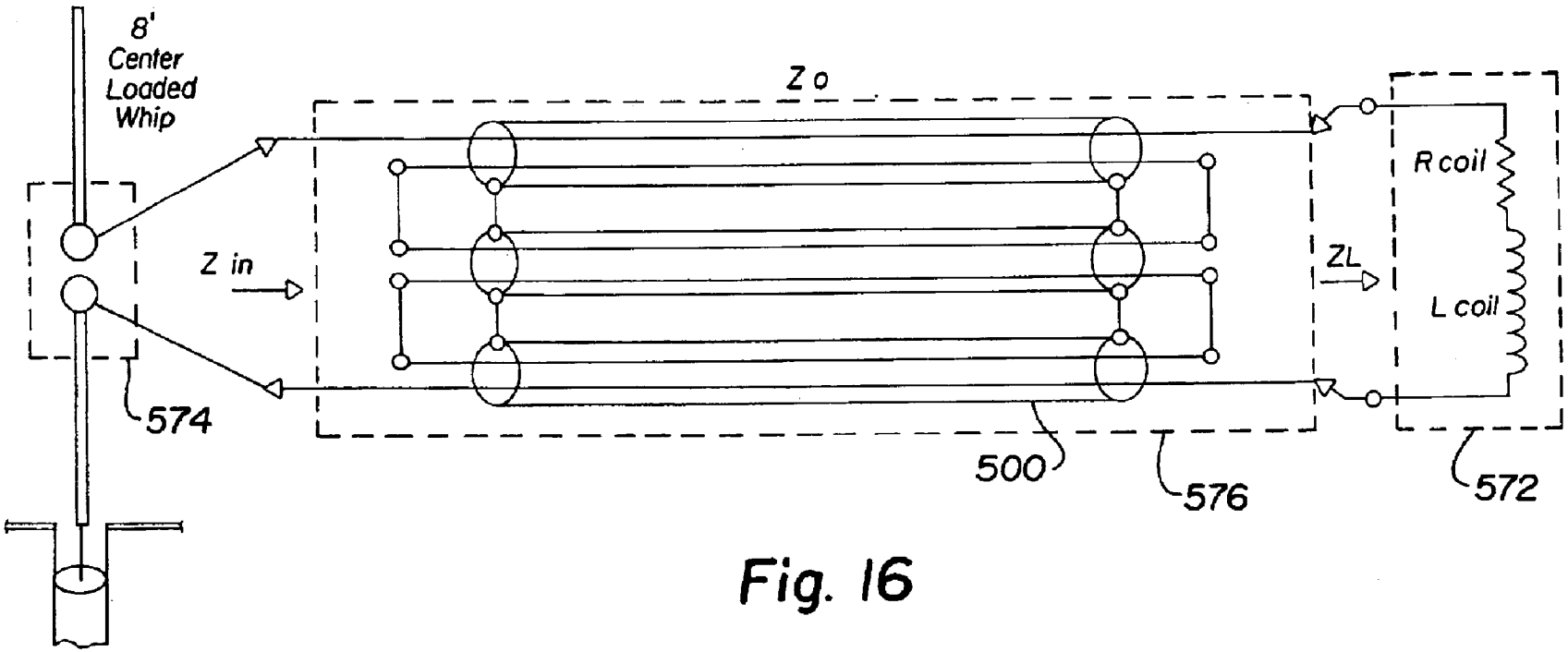
FIG. 16 is a circuit schematic showing representations for an antenna, stacked shielded balanced conductors and an electrical load producing device.

To describe, compare and analyze a theoretical and the measured performance loss parameters of an actual antenna, the following information is provided. With reference to this analysis, block 574 represents the center interface of a standard 8' vertical loaded whip antenna and block 572 represents the electrical load producing device. As shown in FIG. 15, the transmission line assembly 576 has representative resistance loss R for a balanced transmission line assembly and electrical load producing device 572 is a coil with resistance loss. FIG. 16 illustrates an overall schematic representation of a three cable stacked balanced transmission line assembly 576. A shielded balanced conductor pair is represented by reference number 500.

A conventional 8' center loaded mobile whip antenna operating at a frequency of 3.8 MHZ requires a coil (inductance) of approximately 150 uH (L) to resonate the antenna for maximum efficiency. The reactance value is 3.58K ohms. XL (reactance value)=2×pi×F×L where F=frequency in MHZ and L=microhenrys. The actual antenna impedance is capacitive at the center of 3.58K ohms. This reactance has been tuned out by mounting a coil directly at the center. Presently the reactance coil must be large to reduce the coil losses. The size and weight of the coil required to resonate the antenna creates many mechanical problems.

The problem plaguing prior art antenna loading reactance configurations has been that the overall resistive losses are too high and produce unacceptable antenna gain and these losses increase rapidly the further the load is displaced from the antenna elements.

To solve this problem, a very low loss transmission line assembly constructed according to the present invention is used. In addition to consideration of the ohmic losses, the transmission lines must be transparent to the RF fields generated by the actual antenna when the transmission line assembly is external to the antenna as shown in FIG. 1. The floating shields provide this transparency with the shield length segments being adjusted as required to eliminate self resonance. Also, the antennas incorporate the use of high characteristic impedance $Z_0$ shielded balanced transmission line conductors.

To reduce the line losses, the transmission line conductor pairs can be stacked as desired to raise the characteristic impedance and significantly lower the transmission line losses. This permits a significantly higher $Z_0$ effective characteristic cable impedance in a small space as opposed to a single balanced cable. The spacing of a single balanced cable or an unbalanced cable would prohibit its efficient use in these antennas.

Transmission lines are normally used for transferring power between a source and resistive, i.e. non-reactive, loads where the resistive loads match the characteristic impedance of the transmission line. The antennas use the transmission line assembly to transfer the load (a predominantly reactive load only) to the center of the antenna. This places an extreme requirement on the transmission line techniques to significantly reduce the line losses under these extremely high VSWR conditions. The techniques used in these antennas do that and the antennas exhibit essentially the same gain between a direct center loaded antenna and a remote loaded antenna as shown later.

The transmission line assembly length transforms the remote reactance to a new value at the center of the antenna. This transformer action becomes part of the reactance and the remote coil size required is proportionately less with longer transmission line assembly lengths. However, there is a trade off (i.e. a race) between the increasing 'line losses' vs. the reduction in coil losses as the length increases.

The Q of a Coil is a Figure of Merit for minimum coil lose resistance. The higher the Q the more efficient the coil. As shown in the following formula, Q=X/R where X is the coil's inductive reactance in ohms and R is the coil's equivalent series loss resistance in ohms.

It is important to note that in mobile mounted vertical antennas there are high ground losses at HF freguencies and below. However, any improvement in the basic antenna radiator, i.e., the reduction of losses, is directly translated into an increase in antenna gain and efficiency regardless of the ground losses which remain a constant factor. Therefore, the changes to the basic radiator efficiency will only be considered.

If the electrical load producing device is remotely located via a transmission line assembly, the assembly will introduce some losses of its own. This is represented by a resistance in series with the resistance of the remote coil. The overall series loss resistance must be kept low to minimize gain differences between a center loaded antenna using a mounted center coil, the electrical load producing device, vs. a remote coil, the electrical load producing device, using a transmission line assembly for transferring the signals to the center of the antenna, as in this example.

The input impedance $Z_{in}$ of the transmission line assembly is determined from the "Transmission Line Equation," which is taken from 1994 ARRL Antenna Handbook pg. 24–10 (Eq 13).

$$Z_{in} = Z_o \times \left[\frac{Z_L \cosh(\gamma l) + Z_o \sinh(\gamma l)}{Z_L \sinh(\gamma l) + Z_o \cosh(\gamma l)}\right]$$

where $Z_{in}$=complex impedance at input of line $Z_L$=complex load impedance at end of line=$R_a \pm jX_a$ $Z_O$=characteristic impedance of line=$R_0 \pm jX_O$ $\gamma$=complex loss coefficient=$\alpha + J\beta$ $\alpha$=matched-line loss attenuation constant, in nepers/unit length (1 neper=8.688 dB; most cables are rated in dB/100 ft)

$$\beta = \text{phase constant of line in radians/unit length}$$

$$= \frac{2\pi}{VF \times 983.6/f(\text{MHZ})}, \quad \text{for } l \text{ in feet}$$

for l in feet

VF=velocity factor f(MEZ)=frequency in MHZ l=electrical length of line in same units of length measurament (feet) as $\alpha$ or $\beta$ above The input $Z_{in}$ (inductive load) required for this center loaded antenna example is 3.58K ohms for an 8 foot center loaded whip and 6 foot length of the transmission line assembly.

The following Table A shows the theoretical analysis comparison of the loss characteristics ($R_c$ verses $R_{in}$) between a conventional antenna (in the first column) and remote loaded configuration antennas (in the remaining columns). A frequency of 3.8 MHZ was used.

TABLE A

| Conventional Center Loaded Coil Antenna Vehicle Mounted 8' Whip Coil Q = 300* Coil Q = 500** | Typical Inductance Value Range @ Resonance | Electrical Load Producing Device | | Transmission Line Assembly (6') Typical Low Loss Cables (3.8 MHz) | |
|---|---|---|---|---|---|
| Coil Z | $Z_{in}$ | ZL | Q | | |
| $R_c + jX_c$ | $R_{in} + jX_{in}$ | RL + jXL | XL/RL = | $Z_o$ | db/100' |
| 12 + j3580* | 38 + j3554 | 3.6 + j1100 | 300* | 300 | .18 |
| 12 + j3580* | 21 + j3462 | 6 + j1800 | 300* | 600 | .03 |
| 12 + j3580* | 17 + j3456 | 7 + j2100 | 300* | 900 | .025 |
| 7 + j3580** | 10 + j3456 | 4 + j2100 | 500** | 900 | .025 |
| 12 + j3580* | 17 + j3597 | 8 + j2350 | 300* | 1200 | .02 |
| 7 + j3580** | 11 + j3597 | 5 + j2350 | 500** | 1200 | .02 |

The first column of Table A "Conventional Center Loaded Coil Antenna" is the required inductance for resonating the antenna for maximum efficiency using a coil Q of 300. The coil resistance is 12 ohms (7 ohms for Q of 500). Power to this resistance is lost.

The second column of Table A "Typical Inductance Value Range" is the $Z_{in}$ input inductance of a typical 6' transmission line assembly.

The third column of Table A "Electrical Load Producing Device" uses Load ZL values and constant coil Q of 300 (except 500 where noted) that will provide the proper $Z_{in}$ equivalent to the center of the antenna. This value will resonate the antenna since it is in the inductive reactance range of 3580 ohms required.

The fourth column of Table A "Transmission Line Assembly" shows the characteristic impedance $Z_O$ values used. Typical low line loss values were used for a frequency of 3.8 MHZ.

Table A shows in the conventional installations that the $R_c$ values are for a coil Q of 300. A coil Q of 500 requires a larger coil.

In the remote electrical load producing device configuration of this invention, the $R_{in}$ value is present at the center of the antenna. Power to these resistance values $R_c$ and $R_{in}$ are lost.

Table A starts with a $Z_O$ of 300 ohms. Lower values are considerably less efficient.

Note that $R_{in}$ is 38 ohms, which is extremely lossy as opposed to using the $Z_O$ value of 900 ohms, and the $R_{in}$ drops significantly to a value of 10 ohms using a coil Q of 500, which is very efficient because of the low loss.

Note that as the $Z_O$ increases to a practical limit the values of $R_{in}$ drop considerably. Any power to this $R_{in}$ is lost as is the case with the conventional coil $R_c$ mentioned in Column 1. For this particular frequency range of 3.8 MHZ a transmission line assembly $Z_O$ of 900 ohms is a practical value. A trade off between coil Q and $Z_O$ can be done to determine the optimum practical cost, size, and weight effective combinations for any antenna.

The value of the remote loaded configuration ZL with lower reactance or smaller coil size is less than that required by a conventional coil. This also contributes to decreasing the coil loss RL. It is easier to install smaller coils.

The $R_{in}$ value can be in the same range as the $R_c$ value as the coil Q is increased. For comparison purposes—a coil Q of 300 (except 500 where noted) was used for both electrical load producing device and the conventional coil.

When the on value is the same as the $R_O$ value, the antenna efficiencies and gains are the same. The $R_{in}$ value with low loss line and high Q coil characteristics, which is easier to accommodate for remote lower inductance coils, can essentially match the $R_c$ value.

The tests were conducted to compare and validate the theoretical analysis with actual field strength measurements.

In the field, center loaded antennas were individually set up on a ground plane. The same antenna base section and top section were used in all cases.

A comparison was made between a conventional antenna and the center loaded antennas constructed according to the present invention. The first set of tests utilized a ground mounted wire ground plane to an antenna mount. The second set of tests utilized a vehicle ground plane with an antenna mount. The first set of tests showed the same gain results between the three antennas with the same ground loss to each antenna. The second set of tests showed the same gain results between the three antennas with the same ground loss to each antenna. This provides an equal comparison of center loading antennas with the center loading configuration exchanged during the tests.

An antenna coupler was used to feed the antennas at the base coax. The antenna coupler matched the low input impedance of the tuned antennas. The base feed impedance had approximately the same values. A frequency of 3.8 MHZ was used. The electrical load producing device of applicant's antennas were tuned for resonance (minimum VSWR) and the coil of the conventional antenna was tuned for resonance (minimum VSWR).

A low power transmitter was used to feed identical power to each antenna configuration test.

A fixed remote receive sense antenna was used to measure the radiated signal levels.

The tests show that the antenna gain of each antenna was essentially the same. The antenna gains of applicant's antennas were within 0 to minus 1.5 dB of the conventional antenna. The same coil was used for the electrical load producing device as in the conventional antenna. For applicant's antennas, the number of coil turns were reduced for lower inductance from that used for the conventional coil center. Each test verified that the coil inductance required for the electrical load producing device was less in accordance with the theoretical findings described.

Therefore, the field test showed that when the antenna resistive losses are the same at the center of the antenna, the antenna efficiencies are the same with all other items being equal.

What is claimed is:

1. A radio antenna, comprising: top and base sections; an insulator disposed between said sections; and electrical load providing device being disposed away from said insulator by a distance sufficient to reduce wind loading effects, weight, structural and electrical complexity; and a transmission line having conductor lengths sufficient to extend between said insulator and said electrical load providing device.

2. The antenna set forth in claim 1, further comprising: the base section being tubular, and said transmission line being disposed within the tubular base section.

3. The antenna set forth in claim 1, further comprising: the pair of conductors being shielded as a single unit.

4. The antenna set forth in claim 3, further comprising: the conductors having first and second ends, the first end of one of the conductors being connected to said top section at a location near said insulator and the first end of the other conductor being connected to the base section at a location near said insulator, and the second ends of the conductors being connected on an other side of said electrical load providing device.

5. The antenna set forth in claim 1, further comprising: said transmission line assembly including a plurality of pairs of conductors, each of the pair of conductors of the plurality of pairs having a predetermined characteristic impedance rating.

6. The antenna set forth in claim 5, further comprising: each pair of conductors being shielded as a single unit.

7. The antenna set forth in claim 5, further comprising: one of the conductors of a first pair having a first end connected to the top section at a location near said insulator and a second end connected on one side of said electrical load providing device, one of the conductors of a last pair having a first end connected to the base section at a location near said insulator and a second end connected on another side of said electrical load providing device, the other conductors of the plurality of pairs being connected to one another to form a plurality of closed loops.

8. The antenna set forth in claim 1, further comprising: said transmission line assembly including a plurality of pairs of conductors, the pairs of conductors being supported within an elongated tubular metal body to provide a shield.

9. The antenna set forth in claim 8, further comprising: each pair of conductors being separated from one another by a shield forming metal wall extending substantially the length of and connected to the elongated tubular metal body.

10. The antenna set forth in claim 9, further comprising: the shield forming metal wall separating the pairs of conductors having generally a V-shape.

11. The antenna set forth in claim 9, further comprising: the shield forming metal wall separating the pairs of conductors having a central axis extending along an axis formed by the elongated tubular metal body and arms extending radially from the central axis toward the elongated tubular metal body.

12. The antenna set forth in claim 11, further comprising: the elongated tubular metal body forming said base section.

13. A transmission line assembly for increasing a characteristic cable impedance utilizing a plurality of pairs of conductors added to one another across an electrical load providing device, comprising: a plurality of pairs of conductors, each of the conductors of the plurality of pairs having a predetermined characteristic impedance rating, each of the plurality of pairs of conductors being shielded as a single unit, one of the conductors of a first pair having an end connected on one side of an electrical load providing device, one of the conductors of a last pair having an end connected on another side of the electrical load providing device, the other conductors of the plurality of pairs being connected to one another to form a plurality of closed loops.

14. The antenna set forth in claim 13, further comprising: the pairs of conductors being supported within an elongated tubular metal body to provide a shield, and each pair of conductors being separated from one another by a shield forming metal wall extending substantially the length of and connected to the elongated tubular metal body.

15. The antenna set forth in claim 14, further comprising: the shield forming metal wall separating the pairs of conductors having generally a V-shape.

16. The antenna set forth in claim 14, further comprising: the shield forming metal wall separating the pairs of conductors having a central axis extending along an axis formed by the elongated tubular metal body and arms extending radially from the central axis toward the elongated tubular metal body.

17. The antenna set forth in claim 16, further comprising: an external metal wall surrounding and insulated from the elongated tubular metal body.

18. The antenna set forth in claim 17, further comprising: the external metal wall forming said base section.

* * * * *